United States Patent [19]

Toplak

[11] 4,112,613

[45] Sep. 12, 1978

[54] SPINNING TOY

[76] Inventor: Steve Toplak, 14 Islay Ct., Weston, Ontario, Canada, M9M 1V3

[21] Appl. No.: 802,622

[22] Filed: Jun. 2, 1977

[51] Int. Cl.[2] ..... A63H 27/00

[52] U.S. Cl. ..... 46/83; 46/70

[58] Field of Search ..... 46/82, 83, 75, 84, 85, 46/65, 70, 67, 68, 69; 244/8, 17.11, 39

[56] References Cited

U.S. PATENT DOCUMENTS

| | | | |
|---|---|---|---|
| 634,996 | 10/1899 | Platt | 46/83 |
| 1,326,457 | 12/1919 | Lalonde | 46/83 |
| 1,907,084 | 5/1933 | Morini | 46/72 |
| 2,242,770 | 5/1941 | Ayers | 46/83 |
| 3,921,939 | 11/1975 | Garfinkle | 244/17.25 |

*Primary Examiner*—Louis G. Mancene
*Assistant Examiner*—Mickey Yu

[57] ABSTRACT

The specification describes a flying top having an elongated lower portion for winding a string therearound and an enlarged upper portion which is provided with wings for flying the top upon rapid unwinding of the string.

4 Claims, 6 Drawing Figures

SPINNING TOY

FIELD OF THE INVENTION

This invention relates to a spinning top provided with wings for flying the top as it spins.

BACKGROUND OF THE INVENTION

In the past it has been necessary for a young child to play on a hard, flat surface such as a hardwood floor or a cement driveway in order to effectively operate a spinning top. Such a surface is of course required because presently known tops, once spun, descend to the ground where they spin or rotate on a hardened shank provided on the lower end of the top. Therefore the top as described above cannot be used in a grassy area such as a park or field where children generally like to play.

BRIEF SUMMARY OF THE INVENTION

The present invention provides a spinning top having an elongated lower portion for winding the string therearound and an enlarged upper portion provided with wings for flying the top upon rapid unwinding of the string. Therefore the top according to the present invention is not restricted to use on a hardened surface, but rather can be used in almost any area where a child wishes to play.

BRIEF DESCRIPTION OF THE DRAWINGS

A preferred embodiment according to this invention will become more apparent in the following detailed description of that preferred embodiment wherein.

DETAILED DESCRIPTION OF THE PREFERRED EMBODIMENTS

Figure 1:
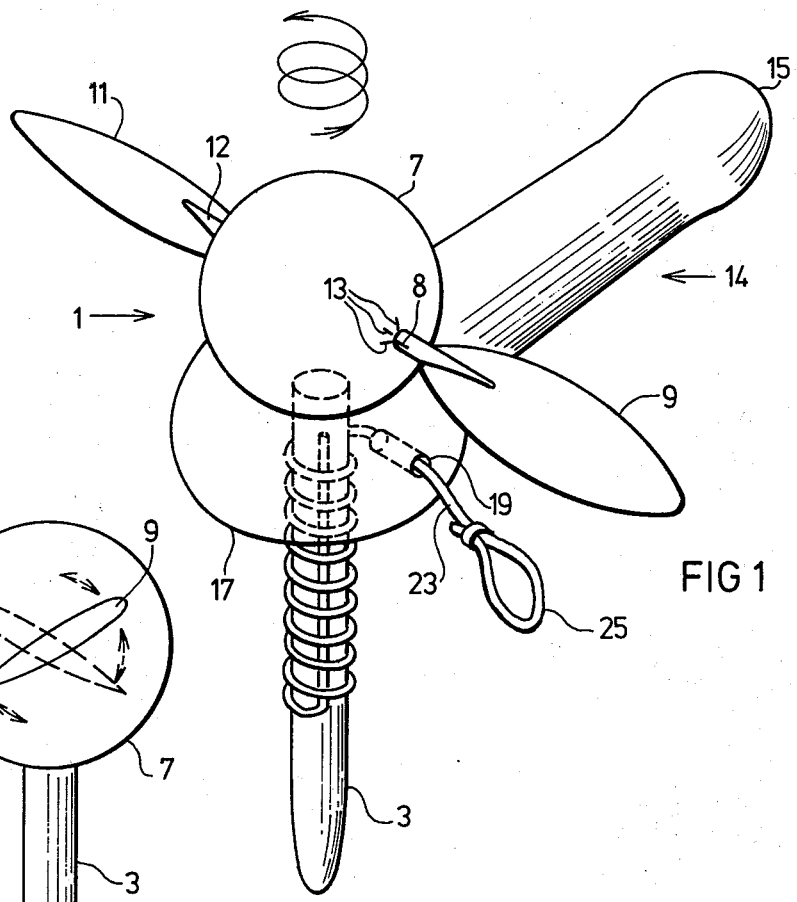
FIG. 1 is a perspective view looking down on the spinning top according to this invention in combination with a launching mechanism for launching the top.
Figure 3:
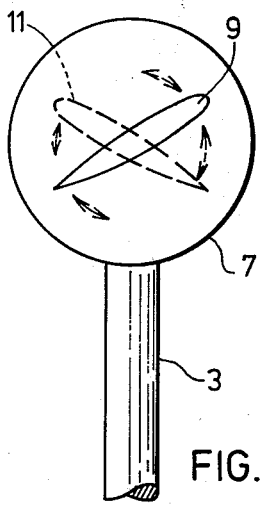
FIG. 3 is a side view of the top shown in FIG. 1.

Referring to FIG. 1, the spinning top generally indicated at 1 comprises an elongated lower section or shank 3 and an enlarged upper bulbous portion 7. Extending outwardly from the upper portion and diametrically opposed to one another are a pair of wings or blades 9 and 11. The top could of course include more than two blades. It could be provided with three or more blades spaced equidistantly from one another. In order to effectively fly the top the pitch is consistent from blade to blade and the leading edge of one blade is positioned above the trailing edge of an adjacent blade. In the embodiment shown in FIG. 3 including a pair of diametrically opposing wings, the slope of wing 9 is equal and opposite to the slope of wing 11 with respect to the reference plane.

Figure 2:
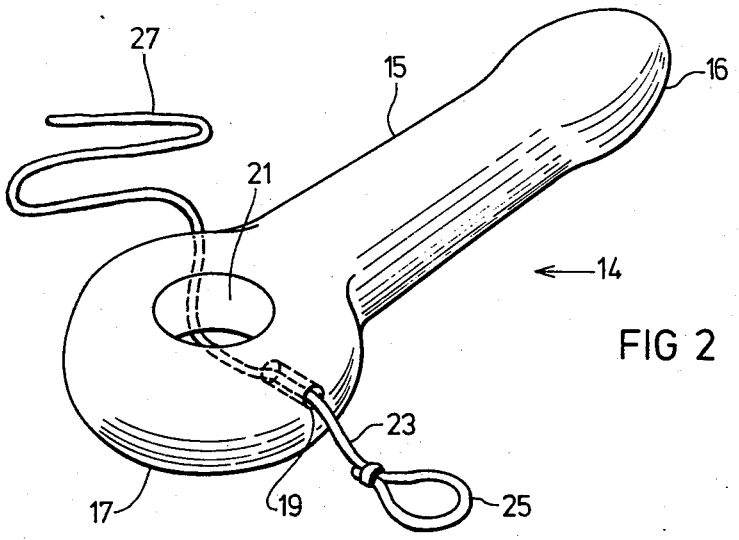
FIG. 2 is a perspective view looking down on the launching mechanism shown in FIG. 1.

The launching mechanism for launching top 1 is best shown in FIG. 2. The launching mechanism, generally indicated at 14, comprises a holder 15 and a string 23. Holder 15 includes a handle portion 16 and a head 17. Head 17 is provided with an aperture or orifice 21 which is adapted to receive lower portion 3 of top 1 with upper portion 7 of top 1 seated on head 17. Also provided in head 17 is a transverse passage 19 extending from aperture 21 through the head. A loop 25 is provided for grasping one end of the string. String 23 can be made of any suitable material such as nylon or the like. In order to prevent fraying of the string, free end 27 can be coated, or in the case of nylon, it can be heated to melt the strands of nylon together.

In a preferred form of the invention, the slope or pitch of wings 9 and 11 is adjustable to very the flying height of top 1. According to this embodiment, the two wings are moveable independently of one another. A plurality of adjustment markings 13 are provided on upper enlarged portion 7 of top 1 adjacent shafts 10 and 12 respectively (only the marks appearing adjacent shaft 10 can be seen in FIG. 1). Furthermore, each of the shafts is provided with an indicator 8 provided on shaft 10, which is aligned with one of the markings 13 according to the desired height of flight. It will be appreciated that in order to vary the flying height of the top, the pitch or slope on each of the wings would be adjusted to the same extent. Markings 13 in combination with indicators 8 therefore provide a height guide for the child using the top.

Figure 4:
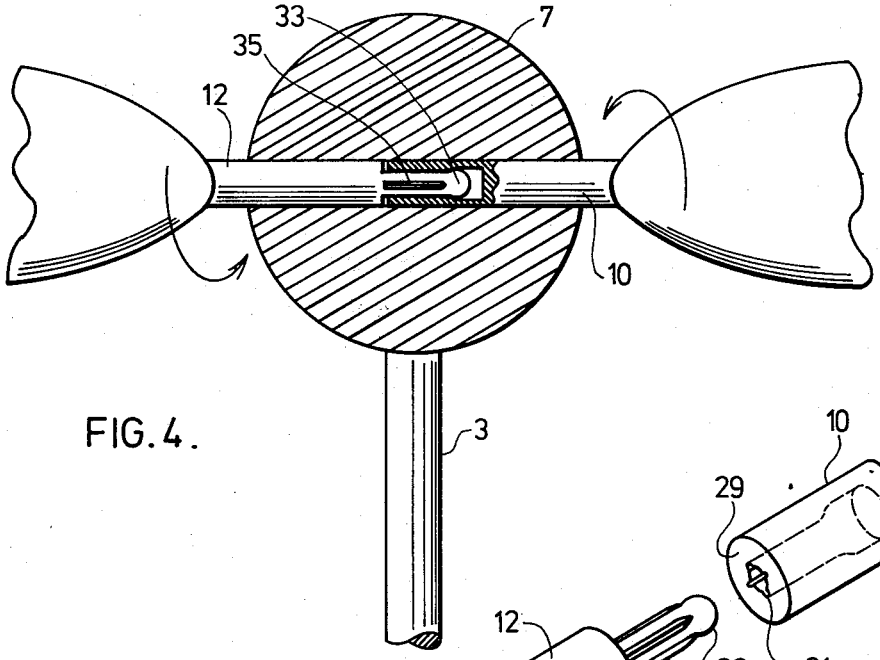
FIG. 4 is a sectional view taken through the upper portion of one embodiment according to this invention.
Figure 5:
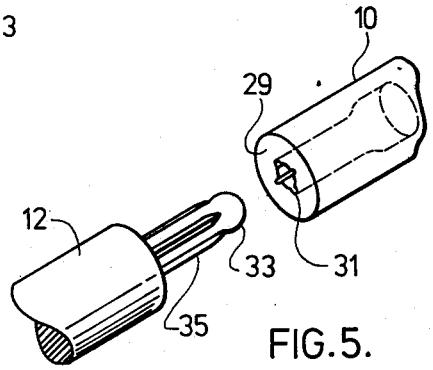
FIG. 5 is an enlarged exploded view of the central portion of the spinning top of FIG. 4.

FIGS. 4 and 5 show a locking arrangement between shafts 10 and 12 in which the wings are individually adjustable. Shaft 10 is hollow at the end remote from wing 9. Wall 29 of shaft 10 is provided with a plurality of internal notches 31. Shaft 12 is on the other hand solid at its end remote from wing 11 and is provided with a plurality of projections 35. The two shafts are constructed from any suitable resilient and relatively wear-resistant material such as high-density polyethylene. In order to assemble the two ends of the shafts, hollow end 29 of shaft 10 is cammed over the tapered end 33 of shaft 12 until projections 35 ar fitted in notches 31, thereby rotatably locking the shafts relative to one another. As can be seen in FIG. 5, due to the shape of the projections and indentations and due to the resiliency of the two shafts, there is provided a rachet mechanism in which the two wings are individually adjustable with respect to one another. In order for a child to adjust the slope of the wings he merely turns them in opposite directions such that each of the projections cams out of its notch into an adjacent notch. The arrangement of components and selection of materials is such that the shafts will not rotate with respect to one another during flight of the top.

Figure 6:
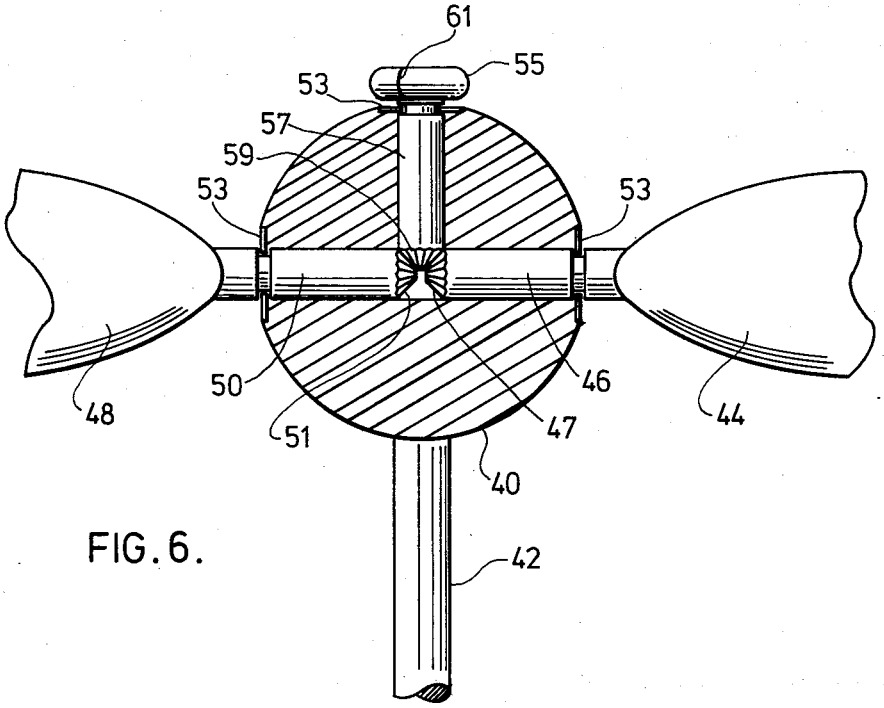
FIG. 6 is a sectional view according to an alternative embodiment according to this invention.

FIG. 6 shows a somewhat different arrangement in which the two wings are adjusted simultaneously in opposite directions through the use of a single adjusting member. According to this embodiment, the top includes an upper enlarged portion 40 and an elongated lower portion 42. Upper portion 40 is provided with a pair of oppositely sloping wings 44 and 48. Also provided in the upper portion is an adjustment member 55. Wing 40 includes shaft 46 provided at its end with a bevel gear 47. Wing 48 includes shaft 50 provided at its end with a bevel gear 51. Adjustment member 55 includes a shadt 57 provided at its lower end with a bevel gear 59. Bevel gear 59 meshes with bevel gears 47 and 51 so that the slope of wings 44 and 48 is adjusted by rotating adjustment member 55. Wings 44 and 48 will of course rotate in opposite directions due to the gearing arrangement.

Wings 44 and 48 as well as adjustment member 55 are locked in position by any suitable means such as collars 53, which are fitted into small grooves provided in shafts 46, 50 and 57. Adjustment member 55 is provided with marking 61 which is aligned with one of the indicators provided on the top (not shown) to indicate the degree of slope adjustment to the wings.

As will be appreciated, there are other methods of adjusting the wings, both individually and through the use of a single adjustment member. For example, in a situation where each of the wings is individually adjusted, the shafts of the wings may simply be threaded into the upper enlarged end of the top to permit rotation or adjustment of each of the wings. An example of a further method of adjusting the slope of both of the wings is to provide each of the wing shafts with a peripheral gear which meshes with the peripheral gear on the shaft of the other wing. In this embodiment the slope of both wings can be adjusted by the manual rotation of an individual wing.

The operation of the flying top is as follows: String 23 is fitted through passage 19 and wrapped or wound around the lower elongated portion of the top in a conventional manner as shown in FIG. 1. The lower elongated portion of the shaft is then fitted through aperture 21 provided in holder 15. The child grasps handle 16 in one hand and pulls hard on string 23 with the other hand. The top is rapidly rotated and rises upwardly from the holder. During flight, the lower elongated portion of the top hangs downwardly as a stabilizing device to maintain the plumb or vertical orientation of the top. The wings can be adjusted such that the top can fly anywhere from an essentially hovering position to a high flying position.

As the rotation of the top decreases, it descends downwardly until it touches the ground. In cases where the child is playing on a hard surface the top may continue to rotate on the tip of the shank. In order to provide this continued rotation on the ground it is important that the top maintain its vertical orientation. Therefore the shank both stabilizes the top during flight and assists in a vertical or upright landing of the top.

The holder and top can be constructed of any suitable material such as a hardened plastic, wood, or the like. The simplicity and durability of the components provide a toy which is inexpensive to manufacture and has a long life expectancy. Furthermore the toy is not restricted to use on a hardened landing surface.

Although various preferred embodiments of the invention have been described herein in detail, it will be apparent to those skilled in the art that variations may be made thereto without departing from the spirit of the invention or the scope of the appended claims.

The embodiments of the invention in which an exclusive property or privilege is claimed are defined as follows:

1. A spinning toy adapted for flight and for subsequent spinning on a landing surface as a top; said toy having an elongated lower stem portion for winding a string therearound which upon rapid unwinding, spins said toy; an enlarged upper portion and wings extending outwardly from said enlarged upper portion for flying said toy; each of said wings comprising a blade and a cylindrical shaft; said enlarged upper portion being provided with a cylindrical passage within which the shafts of said wings are journaled; the ends of said shafts being interconnected by a gear arrangement so that said wings are manually adjustable to vary the flight time to surface spinning time of said toy.

2. A spinning toy as defined in claim 1, wherein the end of one shaft is secured within and geared to the end of the other shaft; the gear is in said gearing arrangement being flexible to permit relative rotation of said wings.

3. A spinning toy as defined in claim 1, wherein the end of each shaft is provided with a bevel gear and said toy includes an adjusting member extending downwardly into said upper enlarged portion in line with said stem and being provided at its lower end with a bevel gear interconnecting the bevel gear ends of said shafts, whereby the rotation of said adjusting member provides relative rotation of said wings.

4. A spinning toy as defined in claim 3, wherein said adjusting member includes at its upper end a knob provided with a wing-adjustment indicator.

* * * * *